US005182845A

United States Patent [19]

Dean

[11] Patent Number: 5,182,845

[45] Date of Patent: Feb. 2, 1993

[54] METHOD OF MAKING STUFFED FIGURE WITH SCULPTURED SOFT FACE

[75] Inventor: David W. Dean, Bath, N.H.

[73] Assignee: DCN Industries, Inc., Boynton Beach, Fla.

[21] Appl. No.: 766,003

[22] Filed: Sep. 26, 1991

[51] Int. Cl.[5] ..... A63H 3/02; B23P 21/00

[52] U.S. Cl. ..... 29/469; 29/451; 446/372

[58] Field of Search ..... 29/428, 451, 469; 446/369, 370, 372

[56] References Cited

U.S. PATENT DOCUMENTS 4,840,603 6/1989 Cahill ..... 446/372

5,123,870 6/1992 Cahill ..... 446/372

*Primary Examiner*—Timothy V. Eley

*Attorney, Agent, or Firm*—Amster, Rothstein & Ebenstein

[57] ABSTRACT

A method of manufacturing a three dimensional stuffed figure provides a face combining the sculptured appearance of a hard face and the softness of a plush face. The face has a front surface of stretch material and a rear surface of non-stretch material defining a stuffing aperture through which is stuffed a quantity of fiberfill sufficient to stretch the stretch material relative to the non-stretch material. Facial details of the front surface of the stuffed face are contoured by tensioning threads (extending from the non-stretch material through the stretch material and back to the non-stretch material) and optionally colored by air brushing. The inverted head is secured to the inverted body to define an inversion aperture, and the inverted head and body are re-inverted through the inversion aperture.

14 Claims, 6 Drawing Sheets

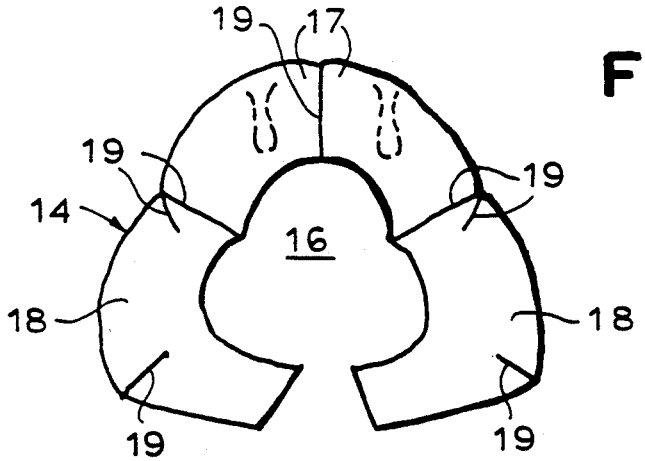
FIG. 2
FIG. 3
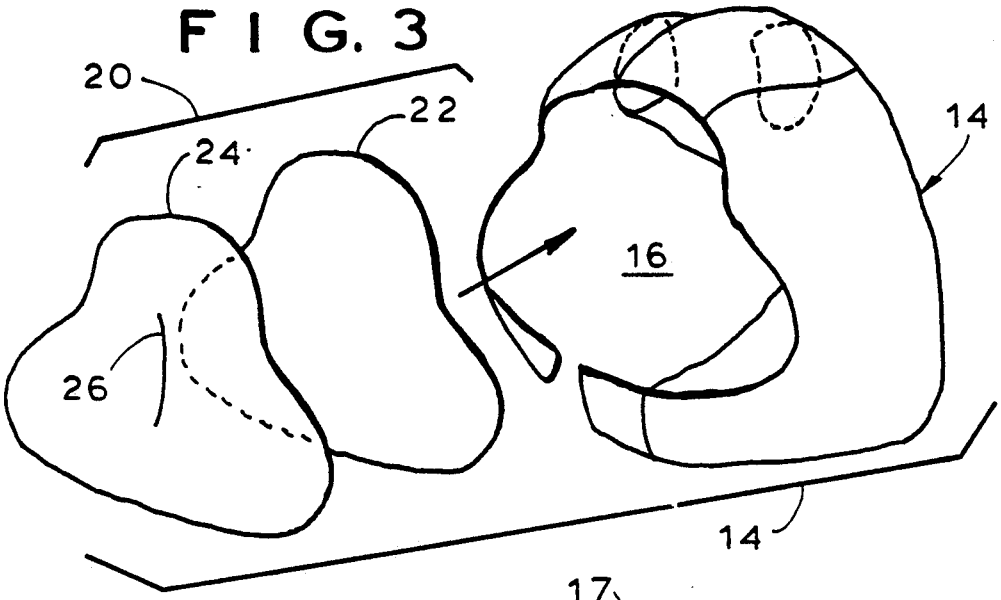
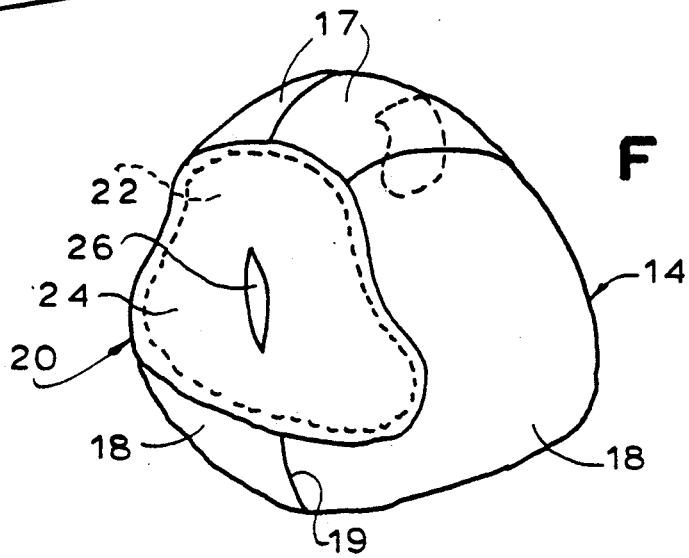
FIG. 4

METHOD OF MAKING STUFFED FIGURE WITH SCULPTURED SOFT FACE

BACKGROUND OF THE INVENTION

The present invention relates to a method of manufacturing a three-dimensional stuffed figure, and more particularly to a method of manufacturing such a figure having the face combining the sculptured appearance of a hard face and the softness of a plush face.

Heretofore, three-dimensional stuffed figures were provided with a face which either provided the sculptured appearance of a hard face or the softness of a plush face, but not both. In order to provide the sculptured detail, the face was typically made of plastic or like hard material which could be molded to provide the desired detailing. Alternatively, in order to provide softness, the face was typically made of a plush material, similar to the plush material used for the body, so as to afford a generally cuddly feel thereto. However, the stuffed plush face could not be contoured and colored to provide the facial details which were obtainable with a hard face since the stuffing of a plush face did not permit the contouring of facial details on the front surface thereof, and the plush material used for the soft face did not lend itself to colorization by air brushing or the like so as to emphasize the facial details.

Accordingly, it is an object of the present invention to provide a method of manufacturing a three-dimensional stuffed figure with a face combining the sculptured appearance of a hard face and the softness of a plush face.

Another object is to provide such a method which is simple and economical.

A further object is to provide a three-dimensional stuffed figure with a face combining the sculptured appearance of a hard face with the softness of a plush face.

SUMMARY OF THE INVENTION

It has now been found that the above and related objects of the present invention are obtained in a method of manufacturing a three-dimensional stuffed figure with a face combining the sculptured appearance of a hard face and the softness of a plush face. The method comprises the steps of providing an inverted plush body and a plush blank configured and dimensioned to form a head and define a facial aperture. A face having a front surface of stretch material and a rear surface of non-stretch material (defining a stuffing aperture) is secured in the facial aperture of the blank. A quantity of stuffing is stuffed forwardly into the secured face through the stuffing aperture in the non-stretch material sufficient to stretch the stretch material relative to the non-stretch material. Facial details of the front surface of the stuffed face are contoured by tensioning threads extending from the non-stretch material through the stretch material and back to the non-stretch material. The contoured head is inverted, the inverted head is secured to the inverted body to define an inversion aperture, and the inverted head and body are then re-inverted through the inversion aperture. The re-inverted head and body are stuffed with stuffing through the inversion aperture and then the inversion aperture is operatively closed.

Preferably the stretch material is two-way stretch material, such as cotton lycra, and the non-stretch material is nylex. The blank is non-stretch material.

In a preferred embodiment, the face front surface of stretch material is secured in the facial aperture separately from the face rear surface of non-stretch material. During the face stuffing step, the quantity of stuffing (preferably fiberfill) stuffed into the face is premeasured by weight to firmly but resiliently stuff the face. As a preliminary part of the contouring step, an apertured mask is removably applied over the front surface of the stuffed face to locate the entry and exit points of the tensioning threads.

The method may include the additional step of inserting artificial eyes inwardly through the stuffed face, so that the eyes create eye sockets in the stuffed face, and fixing the eyes to the non-stretch material prior to the contouring step, and/or the additional step of coloring facial details of the contoured face by air brushing the front surface of the stretch material for color.

The present invention further encompasses a three-dimensional stuffed figure manufactured according to the method.

BRIEF DESCRIPTION OF THE DRAWING

The above and related objects, features and advantages of the present invention will be more fully understood by reference to the following detailed description of the presently preferred, albeit, illustrative, embodiments of the present invention when taken in conjunction with the accompanying drawing wherein:

FIG. 2 is a front elevational view of the head defining a facial aperture;

FIG. 3 is an exploded isometric view of the face elements being inserted into the facial aperture of the head;

FIG. 4 is an isometric view of the head after the face elements have been inserted thereinto;

DETAILED DESCRIPTION OF THE PREFERRED EMBODIMENTS

Figure 1:
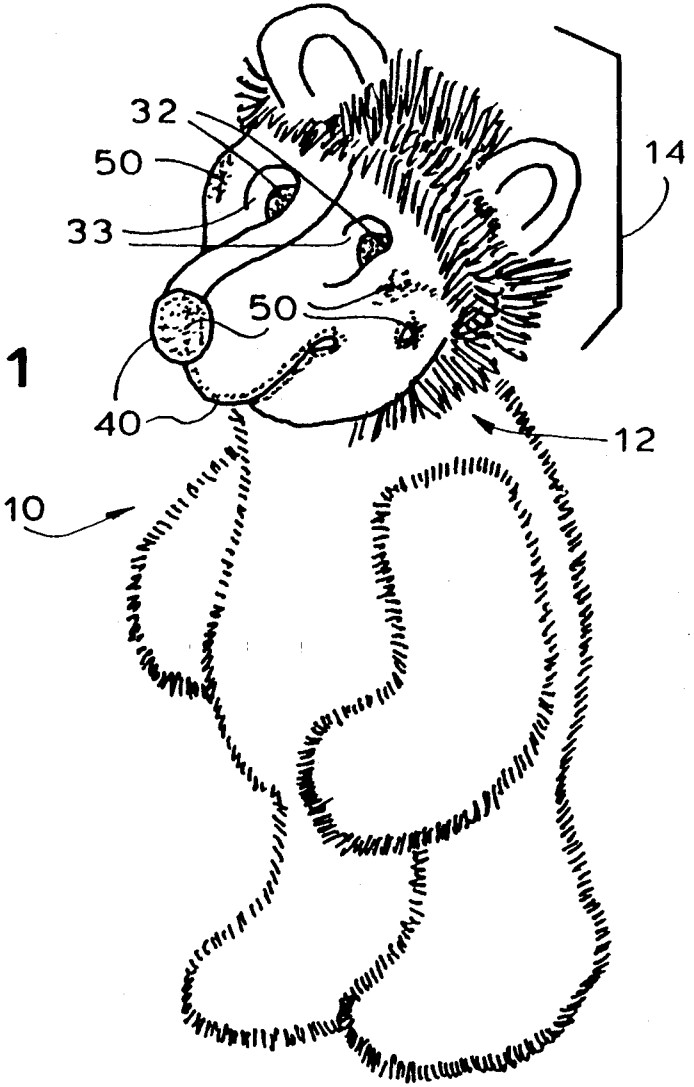
FIG. 1 is an isometric view of a three-dimensional stuffed figure according to the present invention.

The present invention relates to a method of manufacturing a three-dimensional stuff figure with a face combining the appearance of a hard face and the softness of a plush face. The figure may be a human, an animal (such as an elephant, teddy bear or the like), a cartoon figure, a fantasy figure, etc. as desired for the particular application. Referring now to the drawing, for expository purposes only FIG. 1 illustrates a three-dimensional stuffed figure in the form of a bear, generally designated by the reference numeral 10. More particularly, the FIG. 10 includes a body generally designated 12 and a head generally designated 14, the two components 12, 14 being secured together—e.g., by stitching.

Figure 10:
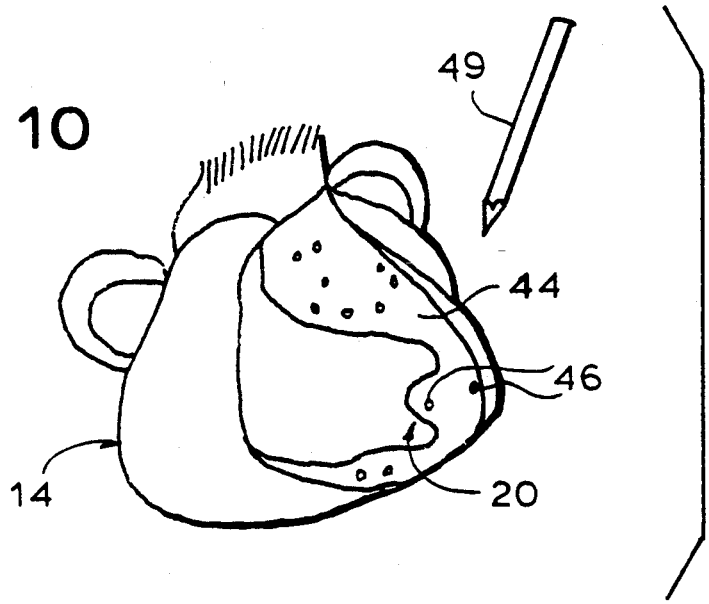
FIG. 10 is an isometric view of the face being marked by crayon through the apertures of the mask.

The body 12 is essentially a plush body of appropriate configurations and dimensions for a particular FIG. 10—here a bear. The body 12 is formed of plush and is typically only broadly characterized without a great amount of detail thereon. As plush bodies of this general type are well known in the stuffed figure art, further details need not be further provided herein.

Referring now to FIG. 2 in particular, the head 14 is formed from a multi-piece blank which is appropriately configured and dimensioned (upon assembly of the pieces) to form a contoured backless and faceless head 14 defining a central facial aperture 16 therein. The blank is preferably a non-stretch plush material, such as acrylic or modified acrylic pile, although other plush materials may also be used. Typically, the head 14 about the facial aperture 16 is defined by a plurality of initially planar pieces of plush material (e.g., top pieces 17 and side pieces 18) which have been darted and secured together, preferably by stitching 19, in order to define a non-planar or contoured blank for the backless and faceless head 14. As the formation of a plush head defining a facial aperture is also well known in the stuffed figure art, further details thereof need not be provided herein.

Referring now to FIGS. 3 and 4, a face generally designated 20 is secured in the facial aperture 16 of the blank head 14. The face 20 has an exposed front surface of stretch material 22 and a concealed rear surface of non-stretch material 24 in the final product, although at this stage the stretch material 22 is on the inner surface and the non-stretch material 24 is on the outer surface of the face 20 in head 14. The stretch material 22 is preferably a soft two-way stretch material capable of stretching along transverse axes, such as cotton lycra, although other suitable two-way stretch material (such as polyester knit) may .be employed. The non-stretch material 24 is preferably a nylon material, such as nylex, although other suitable non-stretch material (such as cotton) may be employed. The non-stretch material 24 defines a stuffing aperture 26 through which stuffing (e.g., fiberfill) may be stuffed intermediate the stretch material 22 and the non-stretch material 24. The stuffing aperture 26 is typically in the form of a short slit (typically an inch or two in length). Preferably, the face front surface of stretch material 22 is secured in the facial aperture 16 separately from (and preferably prior to) the face rear surface of non-stretch material 24. However, it is also possible to secure both materials 22, 24 in the facial aperture 16 at the same time to simplify the manufacturing process.

Figure 5:
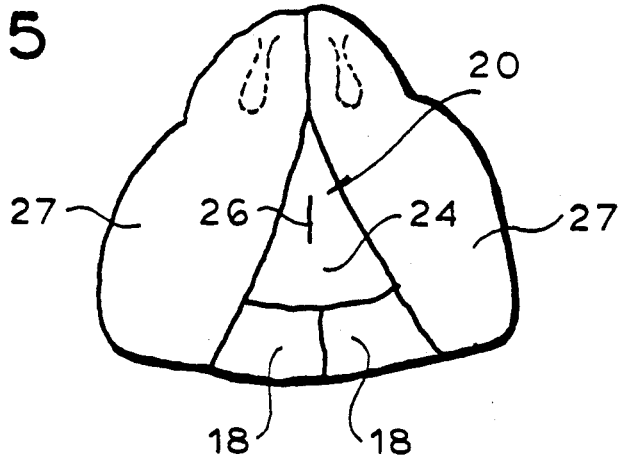
FIG. 5 is a front elevational view of the head after the back portions have been secured thereto.
Figure 6:
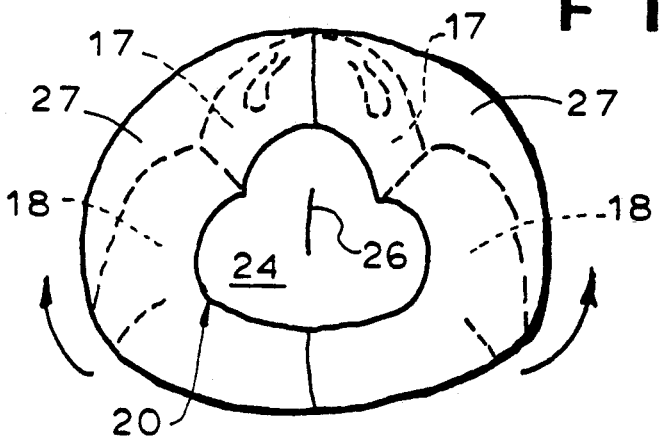
FIG. 6 is a front elevational view of the head with the back head portions being displaced to the sides thereof.

Refer now to FIG. 5, a pair of backs 27 formed of plush material are secured to the top and side pieces 17, 18 of the head 14 and then, as illustrated in FIG. 6, turned back to expose the relatively flat face 20. To this end, each back 27 is secured only on an edge thereof, thereby to define a partial opening between the two backs 27 prior to their being folded back.

Figure 14:
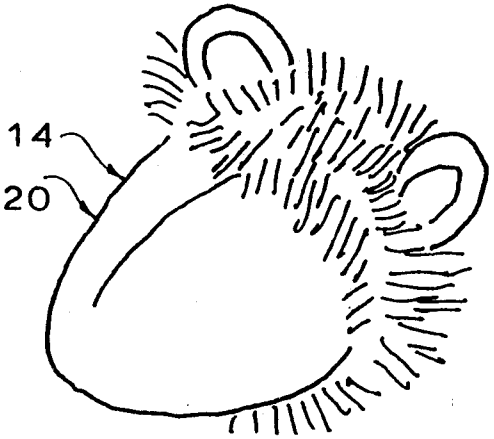
FIG. 14 is an isometric view of the head after it has been stuffed.
Figure 7:
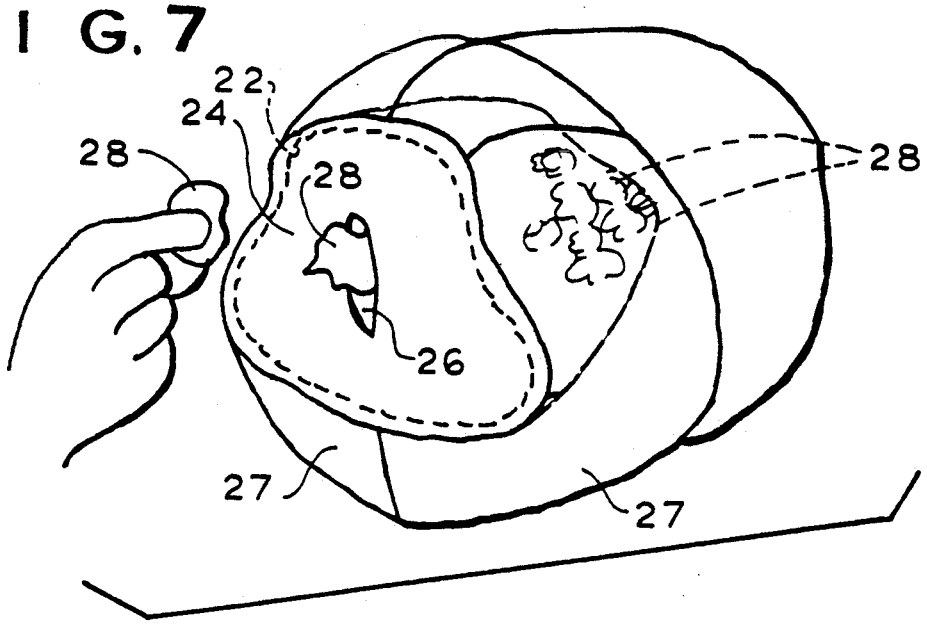
FIG. 7 is an isometric view of a hand inserting stuffing into the face.

Referring now to FIG. 7, after the backs 27 have been turned back to expose face 20, a quantity of stuffing 28 (e.g., fiberfill) is stuffed forwardly into the secured face 20 through the stuffing aperture 26 in the non-stretch material 24, thereby to roughly define the face 20 with a protruding front, as illustrated in FIG. 14. The quantity of stuffing 28 is predetermined, preferably by .weight, in order to stretch the stretch material 22 relative to the non-stretch material 24 sufficiently to firmly but resiliently stuff the face 20. The appropriate premeasured quantity of stuffing 28 will, of course, depend upon the volume to be occupied when the face is fully stuffed, the degree of hardness desired, and the like. It will be appreciated that the stuffing aperture 26 need not be operatively closed after such stuffing since the subsequent presence of the stuffing in the re-inverted head and body of the finished product 1 typically precludes or minimizes the passage of any stuffing from the face 20 into the head 14 or body 12 through the stuffing aperture 26. However, if desired, the stuffing aperture 26 may be operatively closed, as by stitching, immediately after the face 20 has been stuffed.

"Fiberfill" is used herein to indicate any material, whether natural or synthetic, providing a high degree of loft or stuffing. A preferred fiberfill is synthetic wadding or batting such as polyester fiberfill. The quantity of stuffing or fiberfill employed will depend to some degree on the nature of the figure, substantially more stuffing being required to provide the elongated trunk of an elephant than the shorter muzzle of a bear, all other things being equal.

Conventional plush ears 38 (see FIG. 8) may also be secured to the head 14. Each ear 38 is typically formed from two segments, each segment consisting of a plush material peripherally stitched to a non-stretch material (such as nylex). The two segments are placed one on top of the other, with the plush surfaces facing each other, and sewn together about the periphery except for an ear inversion aperture. The ear is then inverted through the ear inversion aperture so that the plush material is on the exposed outer surface and the stitching joining the segments is hidden within the ear. Then the portion of each ear about its inversion aperture is secured (e.g., by stitching) to the head in an appropriate position for the FIG. 10.

Figure 8:
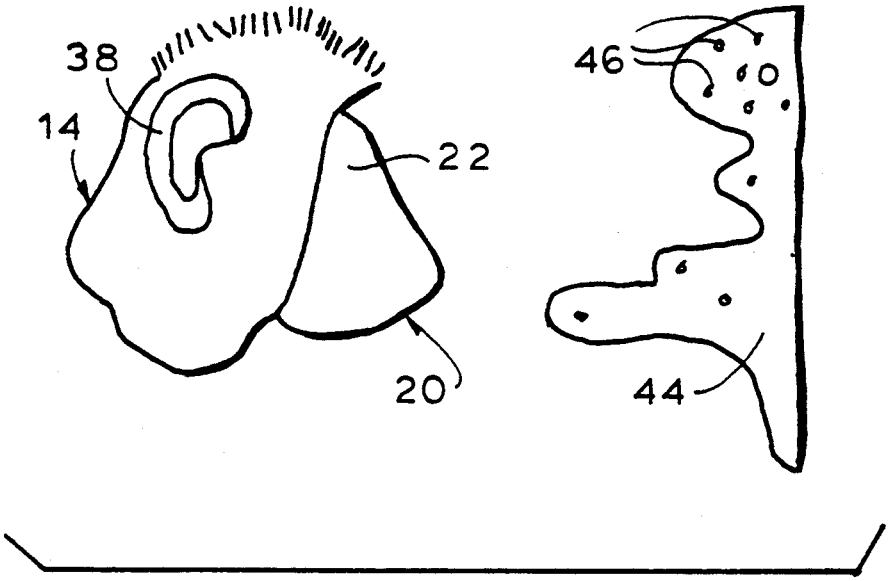
FIG. 8 is a side elevational view of the stuffed head and the apertured mask to be temporarily placed thereover.
Figure 9:
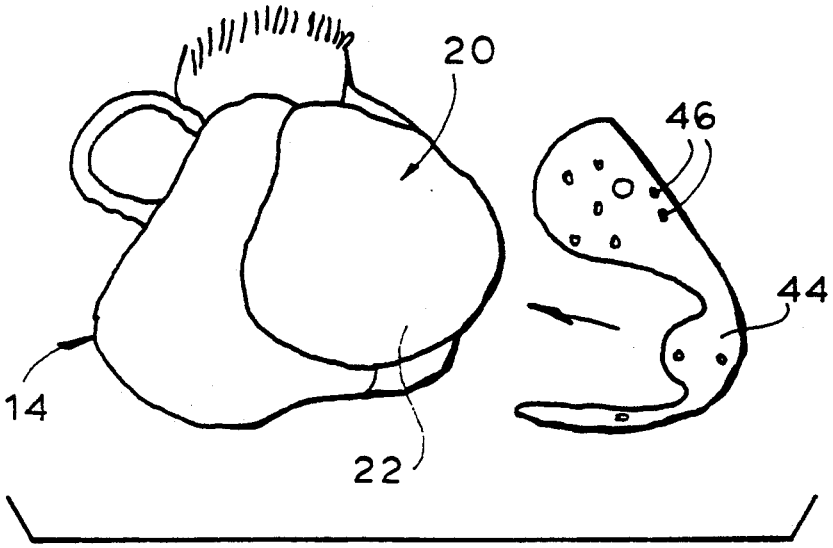
FIG. 9 is an isometric view similar to FIG. 8 except that the mask has been distorted to conform to the face.

Referring now to FIG. 8, the front surface 22 of the stuffed face 20 is contoured with tensioning threads 40 in order to provide facial details. The particular contours are selected as those appropriate to the FIG. 10. In order to facilitate the stuffed face 20 being appropriately marked for the various stitches of the tensioning threads 40 used for contouring, preferably a mask 44 defining apertures 46 therethrough is removably and conformingly contoured about the front surface 22 of the face 20, as illustrated in FIG. 9. Appropriate guide marks 48 are then made through the apertures 46 onto the front surface of the stretch material 22, typically by crayon 49, in order to prelocate the eyes and the stitch locations for tensioning threads 40, as illustrated in FIG. 10. The mask 44 is then removed prior to the application of the eyes and the tensioning threads 40.

Figure 11A:
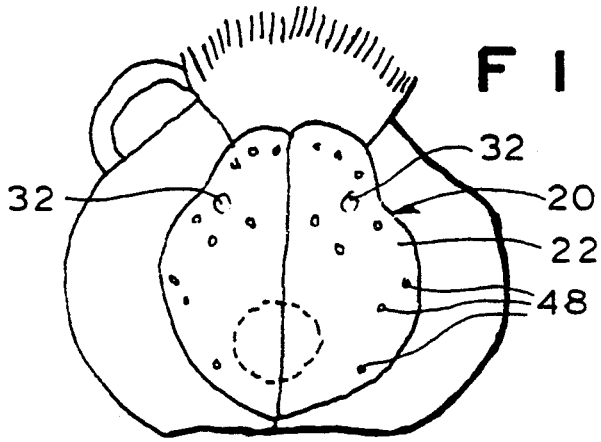
FIGS. 11A 11B are front and back elevational views respectively, of the head after the eyes have been inserted.
Figure 11B:
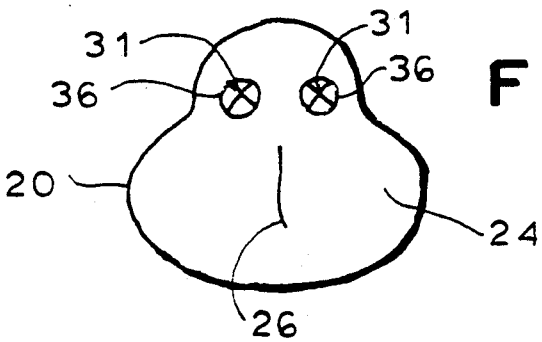

Referring now to FIG. 11A, after the face 20 has been stuffed and marked, the pins or stems 34 of artificial eyes 32 are inserted through the stuffed face so that the eyes 32 create eye socket depressions 33 (see FIG. 15) in the front surface 22 of the stuffed face 20, with the pins 34 of the eyes 32 then being fixed to the non-stretch material 24. A hole is preformed in face 20 for passage of each pin 34 so that the pin 34 extends rearwardly from the back surface 24 thereof. Thus, the pin 34 penetrates the stretch material 22 and the non-stretch material 24 of face 20 and extends inwardly and rearwardly from the non-stretch material 24. While the pin 34 of the eye 32 may be fixed to the face 20 by conventional means, preferably, as illustrated in FIG. 11B, a thermoplastic lock washer 36 is applied to the free end of the pin 34 after its insertion through face 20 to prevent the eye 32 from popping off the face 20. As a further safety measure, the free end of the pin 34 and the washer 36 are then optionally secured together by adhesives, heat fusion or the like to prevent their accidental separation. It will be appreciated that the eyes 32 are an optional feature of the present invention and will not be necessarily present in each and every figure made according to the present invention. Indeed, in certain figures, the eyes 32 may be placed not on the face 20, but rather elsewhere on the head 14 by conventional techniques. The eyes 32 are preferably formed of plastic, such as a thermoplastic material.

Figure 15:
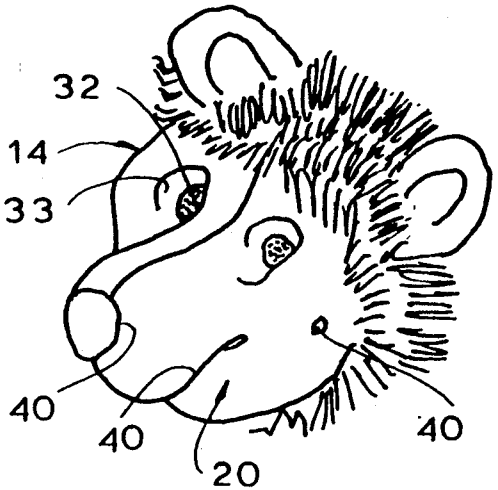
FIG. 15 is an isometric view of the head after it has been stuffed and contoured, but before it is colored.

Referring now to FIG. 15, in order to establish the facial contours, tensioning threads 40 are extended from the non-stretch material 24 defining the back surface of the face 20 through the stretch material 22 defining the front surface of the face 20 and then back to the non-stretch material 24, the tensioning thread 40 being knotted or otherwise secured to the non-stretch material 24 at each end thereof. The tensioning thread 40 is, of course, pulled tightly before the last knot or securement is made in order to provide the desired depression or contouring of the front surface of the face 20, especially about the nose, mouth, lips, dimples, etc. A preferred tensioning thread is formed of non-stretch nylon (16 oz. nominal).

Further facial details which do not require substantial contouring may also be provided through the use of tensioning threads 40, simply by securing one end of the tensioning thread 40 to the non-stretch material 24 and then forming a series of stitches extending through the stretch and non-stretch materials 22, 24 before finally securing the other or free end of the tensioning thread 40 to the non-stretch material 24. The resultant facial detail may be suitable for the mouth or other areas where only a low level of contouring, if any, is required.

Referring now to the head 14 of FIG. 1 only, after the contouring of the facial details of the front surface of the stuffed face 20 by tensioning threads 40, the same or different facial details may optionally be colored—e.g., by air brushing the front surface of the stretch material 22 for color 50. For example, a reddish color paint may be applied to the cheeks to make them rosy, without regard to whether or not the cheeks have been dimpled or contoured by use of tensioning threads 40. Color 50 may also be applied to the eyes, the tip of the nose (to make the front tip of the nose a different color than the remainder of the nose), the mouth, etc. The cotton lycra preferably employed as the stretch material 22 lends itself well to air brushing, as opposed to polyester (which bleeds) and plastic (on which the color does not hold).

Figure 12:
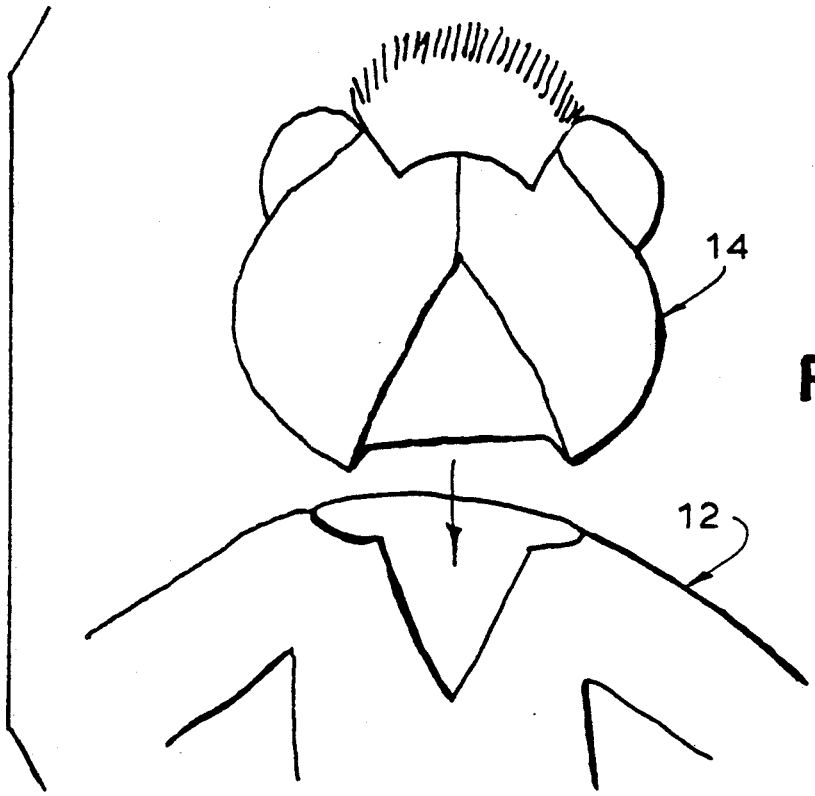
FIG. 12 is a rear elevational view of an inverted head being secured to an inverted body.
Figure 13:
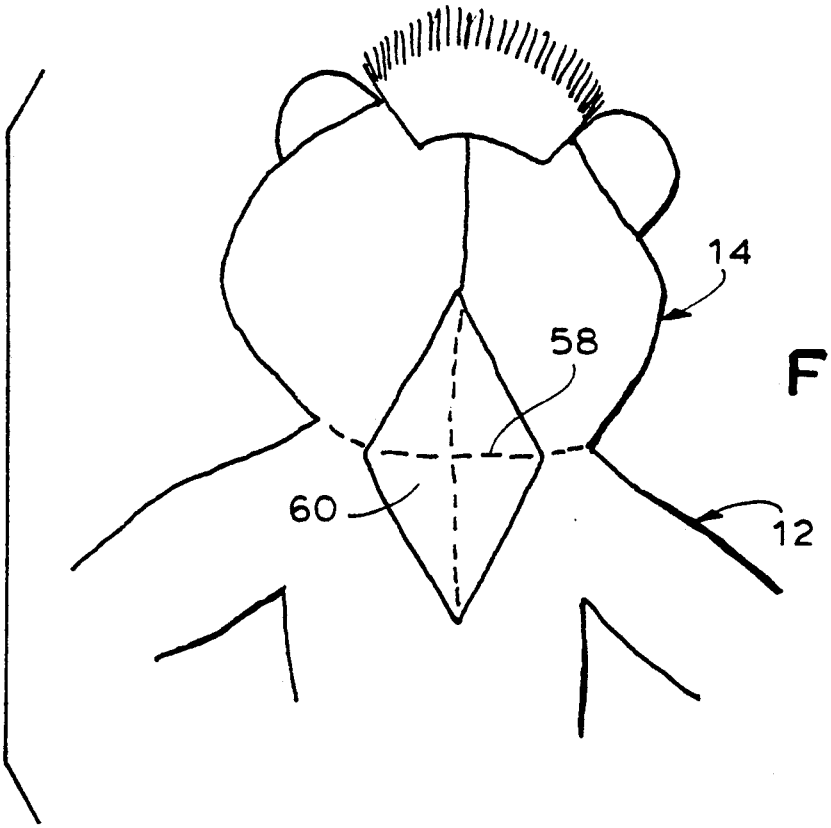
FIG. 13 is an elevational view of the figure after the inverted head and inverted body have been re-inverted.

Referring now to FIGS. 12–13, in order to conceal the stitching required to secure the head 14 and body 12 together, the colored head 14 is inverted and the body 12, if not already inverted, is now inverted. The inverted head 14 is then secured into the inverted body 12, typically by stitching 58, so as to define an inversion aperture 60 of substantial size. Inversion aperture 60 preferably extends partially into the back of the head 14 and partially into the back of the body 12. The inverted head 14 and the inverted body 12 are then passed into and through the inversion aperture 60, so that the intended outer surfaces thereof become visible and the stitching connecting the same becomes hidden.

Referring now to FIG. 1, the re-inverted head 14 and body 12 are then stuffed with more fiberfill 28 through the inversion aperture 60, after which the inversion aperture 60 is closed, typically by stitching. The closing stitching is practically invisible in the finished FIG. 10.

To summarize, the present invention provides a method of manufacturing a three-dimensional stuffed figure with a face combining the sculptured appearance of a hard face and the softness of a plush face, as well as the product of the method of manufacturing. The method is simple and economical.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing disclosure.

I claim:

1. A method of manufacturing a three dimensional stuffed figure with a face combining the sculptured appearance of a hard face and the softness of a plush face, comprising the steps of:

(A) providing an inverted plush body and a plush blank configured and dimensioned to form a head and define a facial aperture;

the facial aperture of the blank a face having a front surface of stretch material and a rear surface of non-stretch material defining a stuffing aperture;

(C) stuffing a quantity of stuffing forwardly into the secured face through the stuffing aperture in the non-stretch material sufficient to stretch the stretch material relative to the non-stretch material;

(D) contouring facial details of the front surface of the stuffed face by tensioning threads extending from the non-stretch material through the stretch material and back to the non-stretch material;

(E) inverting the contoured head, securing the inverted head to the inverted body to define an inversion aperture, and re-inverting the inverted head and body through the inversion aperture; and (F) stuffing the re-inverted head and body with stuffing through the inversion aperture and then operatively closing the inversion aperture.

2. The method of claim 1 wherein the stretch material is two-way stretch material.

3. The method of claim 2 wherein the stretch material is cotton lycra.

4. The method of claim 1 wherein the blank is non-stretch material.

5. The method of claim 1 wherein the non-stretch material is nylex.

6. The method of claim 1 wherein the face front surface of stretch material is secured in the facial aperture separately from the face rear surface of non-stretch material.

7. The method of claim 1 including the additional step of inserting artificial eyes inwardly through the stuffed face so that the eyes create eye sockets in the stuffed face and fixing the eyes to the non-stretch material prior to the contouring step.

8. The method of claim 1 wherein, during the face stuffing step, the quantity of stuffing stuffed into the face is premeasured by weight to firmly but resiliently stuff the face.

9. The method of claim 1 wherein, as a preliminary part of the contouring step, an apertured mask is removably applied over the front surface of the stuffed face to locate the entry and exit points of the tensioning threads.

10. The method of claim 1 including the additional step of coloring facial details of the contoured face by air brushing the front surface of the stretch material for color.

11 The method of claim 1 wherein the stuffing is fiberfill.

12. A method of manufacturing a three dimensional stuffed figure with a face combining the sculptured appearance of a hard face and the softness of a plush face, comprising the steps of:

(A) providing an inverted plush body and a blank configured and dimensioned to form a plush head and defining a facial aperture;

(B) securing in the facial aperture of the blank a face having a front surface of two-way stretch cotton lycra material and a rear surface of non-stretch nylex material defining a stuffing aperture;

(C) stuffing a premeasured weight of stuffing forwardly into the secured face through the stuffing aperture in the non-stretch material sufficient to stretch the stretch material relative to the non-stretch material and firmly but resiliently stuff the face;

(D) inserting artificial eyes inwardly through the stuffed face so that the eyes create eye sockets in the stuffed face and fixing the eyes to the non-stretch material;

(E) removably applying an apertured mask over the front surface of the stuffed face to locate the entry and exit points for tensioning threads and then contouring facial details of the front surface of the stuffed face by tensioning threads extending from the non-stretch material through the stretch material and back to the non-stretch material;

(F) coloring facial details of the contoured face by air brushing the front surface of the stretch material for color;

(G) inverting the colored head, securing the inverted head to the inverted body to define an inversion aperture, and re-inverting the inverted head and body through the inversion aperture; and (H) stuffing the re-inverted head and body with stuffing through the inversion aperture and then operatively closing the inversion aperture.

13. A three-dimensional stuffed figure manufactured according to the method of claim 1.

14. A three-dimensional stuffed figure manufactured according to the method of claim 12.

* * * * *